US009224271B2

(12) United States Patent
Kadlec et al.

(10) Patent No.: US 9,224,271 B2
(45) Date of Patent: Dec. 29, 2015

(54) ALPHANUMERIC SLOT GAME SYSTEM AND METHOD

(71) Applicant: LC Gaming, LLC, Powell, OH (US)

(72) Inventors: Gary F. Kadlec, Columbus, OH (US); Craig R. Sedoris, Dublin, OH (US)

(73) Assignee: LC Gaming, LLC, Powell, OH (US)

( * ) Notice: Subject to any disclaimer, the term of this patent is extended or adjusted under 35 U.S.C. 154(b) by 0 days.

(21) Appl. No.: 14/338,021

(22) Filed: Jul. 22, 2014

(65) Prior Publication Data

US 2015/0317883 A1 Nov. 5, 2015

Related U.S. Application Data

(60) Provisional application No. 61/987,104, filed on May 1, 2014.

(51) Int. Cl.

| | |
|---|---|
| ***A63F 9/24*** | (2006.01) |
| ***G07F 17/34*** | (2006.01) |
| ***G07F 17/32*** | (2006.01) |
| ***A63F 3/04*** | (2006.01) |

(52) U.S. Cl.

CPC ..... *G07F 17/34* (2013.01); *A63F 3/0423* (2013.01); *G07F 17/3227* (2013.01); *G07F 17/3262* (2013.01); *G07F 17/3267* (2013.01); *G07F 17/329* (2013.01); *G07F 17/3211* (2013.01); *G07F 17/3232* (2013.01); *G07F 17/3244* (2013.01)

(58) Field of Classification Search

CPC . G07F 17/3244; G07F 17/32; G07F 17/3267; G07F 17/329; G07F 17/3211; G07F 17/34; G07F 17/3262; G07F 17/3227; G07F 17/3232; G07F 17/3209; A63F 3/0423

USPC ..... 463/16–21, 40–42

See application file for complete search history.

(56) References Cited

U.S. PATENT DOCUMENTS

| | | | | |
|---|---|---|---|---|
| 7,056,215 | B1 | 6/2006 | Olive | |
| 7,306,518 | B2 * | 12/2007 | Hughs-Baird et al. | 463/16 |
| 7,972,210 | B2 | 7/2011 | Gallagher | |
| 8,348,754 | B2 | 1/2013 | Jackson et al. | |
| 8,465,355 | B1 * | 6/2013 | Liang | 463/9 |
| 8,628,411 | B2 | 1/2014 | Okuniewicz | |
| 8,702,493 | B2 | 4/2014 | Nores | |
| 2005/0059465 | A1 * | 3/2005 | Bozeman | 463/18 |
| 2005/0261054 | A1 * | 11/2005 | Bress et al. | 463/20 |
| 2006/0046836 | A1 * | 3/2006 | Walker et al. | 463/20 |
| 2006/0205465 | A1 * | 9/2006 | Dolloff et al. | 463/9 |
| 2008/0076576 | A1 * | 3/2008 | Graham et al. | 463/42 |
| 2008/0108420 | A1 * | 5/2008 | Groves | 463/20 |
| 2008/0243808 | A1 * | 10/2008 | Rieman et al. | 707/5 |
| 2010/0210342 | A1 | 8/2010 | Pollack | |
| 2013/0252720 | A1 * | 9/2013 | Milligan et al. | 463/27 |

* cited by examiner

*Primary Examiner* — Justin Myhr

(74) *Attorney, Agent, or Firm* — Standley Law Group LLP

(57) ABSTRACT

A slot game and systems and methods for administering the slot game wherein the slot administrator defines game parameters that in turn define the contours of the slot game. Game play consists of wagers made on plays of alphanumeric combinations that a player tries to successfully match with the characters on spinning slot wheels.

30 Claims, 5 Drawing Sheets

ALPHANUMERIC SLOT GAME SYSTEM AND METHOD

CROSS-REFERENCE TO RELATED APPLICATIONS

This application claims priority to U.S. Provisional Application No. 61/987,104 filed 1 May 2014, the content of which is hereby incorporated by reference as if fully recited herein.

TECHNICAL FIELD

Exemplary embodiments of the present invention relate generally to slot games, games of chance or wagering type games, and more specifically to systems and methods for providing and administering alphanumeric slot machine type games.

BACKGROUND OF THE INVENTION

Slot type wagering machines (slot machines) have existed for many years and are well known in the art. Generally, players make a bet or play by selecting a wager amount (monetary or non-monetary) and in the case of real money wagering or monetized wagering involving non-cash tokens purchased by a player, both the denomination of the bet as well as the number of times the player wants to play that denomination. For example a player may be wagering using a quarter (25 cent) machine but may decide to play five quarters per spin to increase the stakes and thus the amount paid by the machine ("payout"). Upon selecting the denomination and number of plays, a player may then activate a game play (commonly referred to as a spin) by pressing a button or pulling a slot machine arm.

A great number of games and variations thereon can be played based on this simple construct. In many current cases the player is simply playing against the odds, hoping for example that the same symbols will appear on all 3, 4, 5 or perhaps more wheels when they stop spinning. In addition to mechanical slot machines, many machines in use today are controlled by a computer processor and display digital images or graphics on a display screen, simulating the spinning wheels rather than the actual mechanical wheels used on mechanical implementations of slot machines.

A plethora of slot type games have become available in an effort to keep potential players interested in such games of chance. Despite the great variety in the types of slot games that are available to players, virtually all such games are variations on, or simulations of, the antiquated concept of matching symbols, a basic gambling game design that has been around for decades. Slot game administrators are continually developing new game variations and themes in order to keep interest levels elevated in the games, but many of today's technologically savvy players and younger generation players desire exciting game variations that are not just a rehash of the tired slot concept.

Additionally, many of the slot type games available to players today are centrally designed and administered in a "one size fits all" manner that makes it difficult to cater to the geographic, location, or event-specific, or cultural differences among players. The ability to easily tailor a large variety of slot games for the tastes of a specific location, casino chain, geographic area, discrete event, theme or the like could greatly increase player excitement. In addition, the ability of a player to play a lucky phrase, favorite team, grandchildren's names, etc., may create a perception of better luck. Therefore, such improvements may attract more players to take part in slot type games of chance. The explosion in Twitter users and text messaging, particularly among those under the age of 35, demonstrate a new wave of communication utilizing characters that indicates a need for more character-based and interactive games than are available today.

Furthermore, the existence of a variety of slot type games in the prior art does not translate to administrative ease regarding the offering of a large selection of games to players. Known slot type games are configured such that many game types must be offered in isolation from other games. For instance, many casinos provide a variety of themed slot machines on the premises by providing one or more slot machines specifically configured to provide one theme each, and thereby requiring many machines to offer a significant variety. As such, each such game type may each require multiple systems to make a multitude of games available.

It is therefore an unmet need in the prior art for slot game systems and methods that permit slot game administrators and game locations greater flexibility in the types of games offered. It is further an unmet need that such slot type games not be restricted to matching symbol games, but rather provide for games based on alphanumeric characters and symbols, providing players the choice of those alphanumeric characters and symbols to be used for a particular slot type game, thereby providing increased excitement, meaning and participation for the games, and further providing for easily administered location or event themed games.

BRIEF SUMMARY OF THE INVENTION

The object of the invention is a system and method of configuring, managing, providing and administering slot games, including a system and method for slot game play using definable or selectable phrases as a target phrase which may include letters, numbers, symbols, and the like, each of which may optionally appear in one of a plurality of colors. In embodiments of the invention, players may create their own lucky alphanumeric phrase, or the target phrase may be generated by an administrator or by a server configured to provide generated target phrases. An exemplary embodiment may be comprised of 3 to 12, or more, letters, numbers, symbols, spaces and wildcard indicia. An example of such an embodiment may be a player selecting a phrase such as "LUCKY123." In such an example, all of the 5 letters and the 3 numbers may appear on each of 8 spinning slot wheels. The goal of the slot type game in the example may be to match as many of the letters and numbers in the proper sequence as possible when the spinning wheels stop. Some embodiments include features such as the ability of a player to make multiple spins in one game, and some are provided that allow a player to "hold" selected outcomes from a previous spin. In embodiments of the invention, players may receive point or monetary payouts or otherwise receive awards according to mathematical odds and parameters established by an administrator of such a slot game.

Other embodiments of the invention may add a plurality of colors to the letters, number, and symbols used on the slot wheels. In such an embodiment, a player may select a phrase as described above but may also choose a color of the phrase with a greater payout should the slot wheels display the phrase in the correct color and a lesser payout if the phrase was not displayed in the correct color. Combinations of the correct and incorrect colors may be provided with a lesser reward based upon pay table information that generally corresponds to the probabilities of specific outcomes.

In other embodiments of the invention, a communications network may be used to link a plurality of slot game instances together. In such an embodiment, the embodiment may be configured to allow the plurality of game instances to be managed by a slot administration server via the communications network. In another embodiment, the slot administration server may create a jackpot record to provide a common, shared jackpot amongst the plurality of slot game instances. In another such embodiment, the plurality of instances may be configured to play a common slot game, an example of which may be a game with a common phrase used among the different instances.

In still other embodiments of the invention, a slot type game may allow for a player to interact with the game in a manner that allows, or appears to allow the player to attempt to stop a spinning wheel on the appropriate character. In such an embodiment, player skill or reflexes may improve that player's chances of matching the spinning characters to a phrase. In other embodiments, the system may be configured to select the outcome of the game instance at the same time as the initial spin is made, in which case the stop button would operate to merely display the outcome when pressed.

Embodiments of the invention may allow a player to win points or monetary awards, redeem points, or otherwise purchase additional chances to match a target phrase, reduce the number of possible outcomes, or otherwise affect the chances of winning the game. Examples of such additional chances may include, but are not limited to free spins, wildcards, move a character and a reduction in the number of characters required to be matched.

In accordance with the objectives of the invention and the detailed description herein, a method of providing a slot game on a gaming device is provided. The gaming device has at least a display device, a player interface, a memory, and a storage device. In some embodiments, the gaming device is provided with a network communications device. An exemplary embodiment of the invention includes the steps of setting up the slot game in an initialization stage, determining a total spin result in a gameplay stage, and finalizing the slot game in a settlement stage. The initialization stage includes the substeps of receiving a set of game parameters associated with the slot game, receiving a target phrase having a plurality of characters derived from a set of available characters and a plurality of positions having a linear order wherein each character corresponds to a position, displaying the target phrase on the display device, and preparing a wheel for each position in the plurality of positions. In some embodiments, the step of preparing a wheel may further include the substeps of generating an outcome set having a plurality of outcome characters based on one or more of: the game parameters, the set of available characters and the plurality of characters in the target phrase, and displaying the wheel on the display device wherein the wheel is populated with the outcome set.

In some embodiments, the step of determining a total spin result in a gameplay stage includes the substeps of receiving a spin signal via the player interface device, displaying all wheels in a spinning state on the display device in response to receipt of the spin signal, and displaying each wheel in a stopped state on the display device wherein an outcome character from the outcome set corresponding to the wheel is depicted as a spin result, until all wheels are in a stopped state and the total spin result is displayed comprising the spin results for all wheels.

In some embodiments, the step of finalizing the slot game in a settlement stage includes the substeps of: retrieving pay table information, determining a reward by comparing the total spin result to the pay table information, ending the slot game when the reward is null, and dispensing the reward and ending the slot game when the reward is not null.

In some embodiments, the target phrase is received via the player interface device. In other embodiments, the target phrase is received via a network communications device of the gaming device. Where the target phrase is received via the network communications device of the gaming device, it may originate from another similar gaming device, or it may be generated at a processor of a slot administration server based on a set of available characters and the game parameters in a random or pseudo-random fashion.

Some embodiments include the steps of, after carrying out the step of receiving the target phrase, parsing the target phrase for a match with a disallowed phrase in an exclusion list having a plurality of disallowed phrases, displaying the target phrase on the display device when no match exists, and displaying a request for a new target phrase on the display device when a match exists.

Further embodiments of a method of providing the slot game are provided wherein the set of game parameters include a set of outcome parameters that may be used to customize the plurality of outcome characters that may appear in the outcome sets populated on the wheels. The outcome parameters may include one or more of a character set, a color set and a wild character set, depending upon the games available for play. In some embodiments, the set of available characters includes characters defined by the set of outcome characters—that is, the set of available characters from which the target phrase is constructed is defined at least in part by the set of outcome parameters. Additional embodiments are provided in which the set of outcome parameters further includes a replacement Boolean, wherein the setting of the replacement Boolean defines whether the target phrase is constructed from the set of available characters with or without replacement.

In some embodiments, the set of game parameters includes a set of gameplay parameters that include parameters that affect the gameplay sequence of the slot game. Some embodiments include a positive, nonzero spin limit integer indicating the availability of multiple spins in a slot game instance. Embodiments making use of a spin limit integer are provided wherein the step of determining a total spin result in a gameplay stage further comprises substeps for implementing more than one spin during a slot game instance. A first spin is carried out by receiving a spin signal via the player interface device, displaying all wheels in a spinning state on the display device in response to the receipt of the spin signal, and displaying each wheel in a stopped state on the display device wherein an outcome character from the outcome set corresponding to the wheel is depicted as a spin result. Next, an additional spin is initiated according to the substeps of subtracting 1 from the spin limit integer, receiving a spin signal via the player interface device and a hold Boolean set to false for one or more wheels, displaying all wheels for which the corresponding hold Boolean is false in a spinning state on the display device, displaying each spinning wheel in a stopped state on the display device wherein an outcome character from the outcome set corresponding to the wheel is depicted as a spin result, determining whether the spin limit integer is greater than zero, storing in the memory of the gaming device the total spin result when the spin limit integer is not greater than zero, the total spin result made up of the spin results for all wheels, and repeating the substeps for initiating an additional spin when the spin limit integer is greater than zero.

Additionally, some embodiments are provided with the set of gameplay parameters further including a reorder Boolean set to true. In those embodiments, the substep of initiating an additional spin includes the substeps of subtracting 1 from the spin limit integer, receiving a reorder input via the player interface device, changing the position to which a wheel corresponds for at least two wheels, receiving a spin signal via the player interface device and a hold Boolean set to false for one or more wheels, displaying all wheels for which the corresponding hold Boolean is false in a spinning state on the display device, displaying each spinning wheel in a stopped state on the display device wherein an outcome character from the outcome set corresponding to the wheel is depicted as a spin result, determining whether the spin limit integer is greater than zero, storing in the memory of the gaming device the total spin result when the spin limit integer is not greater than zero, the total spin result comprising the spin results for all wheels, and repeating the substeps for initiating an additional spin when the spin limit integer is greater than zero.

Further embodiments are provided wherein the set of game parameters includes a set of gameplay parameters, wherein the gameplay parameters include a time limit having a positive amount of time. In those embodiments, the step of determining a total spin result in a gameplay stage may include the substeps of actuating a timer control to track an elapsed time, receiving a spin signal via the player interface device, displaying all wheels in a spinning state on the display device in response to the receipt of the spin signal, displaying each wheel in a stopped state on the display device wherein an outcome character from the outcome set corresponding to the wheel is depicted as a spin result, and initiating an additional spin. The step of initiating an additional spin may include the substeps of receiving a spin signal via the player interface device and a hold Boolean set to false for one or more wheels, displaying all wheels for which the corresponding hold Boolean is false in a spinning state on the display device, displaying each spinning wheel in a stopped state on the display device wherein an outcome character from the outcome set corresponding to the wheel is depicted as a spin result, calculating a time remaining equal to the difference between the time limit and the elapsed time, storing in the memory of the gaming device the total spin result made up of the spin results for all wheels when the time remaining is equal to or less than zero, and repeating the substeps for initiating an additional spin when the time remaining is greater than zero.

Additional timed embodiments are provided in which each total spin result for each spin made during the time limit is recorded in a total spin result array during the gameplay stage, allowing many uses of the multiple spin results during the settlement stage, for example, by combining matches from separate spin results, comparing each result to determine the highest reward, and the like. Those timed embodiments include the substeps of storing the spin results for all wheels on a first row in a total spin result array, and in the initiation of each of the one or more additional spins, storing the spin results for all wheels on a new row in the total spin result array.

In some embodiments, the pay table information is retrieved in one or more of the following manners: from the storage device of the gaming device, from an external data source via a network communications device of the gaming device, and from the processor of the gaming device wherein the processor calculates the pay table information based upon the game parameters and the target phrase.

Further in accordance with the invention disclosed herein is a device for playing a slot game. The device includes a storage device, a memory, a display device, a player interface device, and a processor in communication with the storage device, the memory, the display device and the player interface control. The storage device includes a set of game parameters associated with the slot game, a set of available characters associated with the slot game, one or more software routines, and a pay table comprising pay table information. In some embodiments, the processor is provided with the one or more software routines executing thereon and configured to display a target phrase on the display device, the target phrase including a plurality of characters derived from the set of available characters, and a plurality of positions having a linear order, wherein each character corresponds to a position. The processor and one or more software routines executing thereon may be further configured to prepare a wheel for each position in the plurality of position by generating an outcome set comprising a plurality of outcome characters, display each wheel on the display device wherein the wheel is populated with the outcome set, display all wheels in a spinning state in response to a spin signal received from the player interface device, display each wheel in a stopped state wherein an outcome character from the outcome set corresponding to the wheel is depicted as a spin result, wherein a total spin result is displayed having the spin results for all wheels, determine a reward by comparing the total spin result, the target phrase, the pay table information, and the game parameters, dispense the reward when the reward is not null, and end the slot game.

In some embodiments, the one or more software routines are further configured to generate the target phrase based on the set of available characters. In some embodiments they are further configured to display a target phrase selection screen on the display device, and receive the target phrase via the player interface device. Some of those embodiments are provided such that the storage device further includes an exclusion list made up of a plurality of disallowed phrases, and the one or more software routines are further configured to parse the target phrase for a match with a disallowed phrase in the exclusion list, display the target phrase on the display device when no match exists, and display a request for a new target phrase on the display device in connection with the target phrase selection screen when a match exists.

In some embodiments of the invented device, the set of game parameters includes one or more of an order Boolean, a set of color parameters, a set of wildcard parameters, a replacement Boolean, a spin limit integer, a time limit, and a reorder Boolean.

Further disclosed herein is a method of administering a slot game played on a plurality of gaming devices that, in some embodiments, includes the steps of initializing a slot game instance on a slot administration server by retrieving a set of game parameters via a network communications device of the slot administration server, wherein the set of game parameters are associated with the slot game instance, creating a jackpot record in a memory of the slot administration server, and creating an outcomes record in the memory of the slot administration server. The method further includes the steps of receiving a participation signal from each of the gaming devices via the network communications device of the slot administration server, receiving a set of wager parameters from each of the gaming devices via the network communications device of the slot administration server, storing the set of wager parameters received from each of the gaming devices in the jackpot record, and transmitting a target phrase to the plurality of gaming devices via the network communications device of the slot administration server. The target phrase is constructed from a plurality of characters derived from a set of available characters, and a plurality of positions having a linear order, wherein each character corresponds to a position. The method may further include the steps of generating a plurality of outcome characters at a processor of the slot administration server based on one or more of the game parameters, the set of available characters, and the plurality of characters in the target phrase, transmitting the plurality of outcome characters to the plurality of gaming devices via the network communications device of the slot administration server, gathering a set of outcome from the plurality of gaming devices by receiving a total spin result from each gaming device in the plurality of gaming devices via the network communications device of the slot administration server and storing the total spin result for each gaming device in the plurality of gaming devices in the outcomes record, and finalizing the slot game in a settlement stage by retrieving pay table information, determining at least one reward at the processor of the slot administration server based on the outcomes records and pay table information, and dispensing the at least one reward.

In some embodiments, the method is provided wherein the target phrase is received via the network communications device of the slot administration server from a gaming device in the plurality of gaming devices. In other embodiments, the target phrase is generated at a processor of the slot administration server based on the set of available characters and the game parameters.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Figure 1:
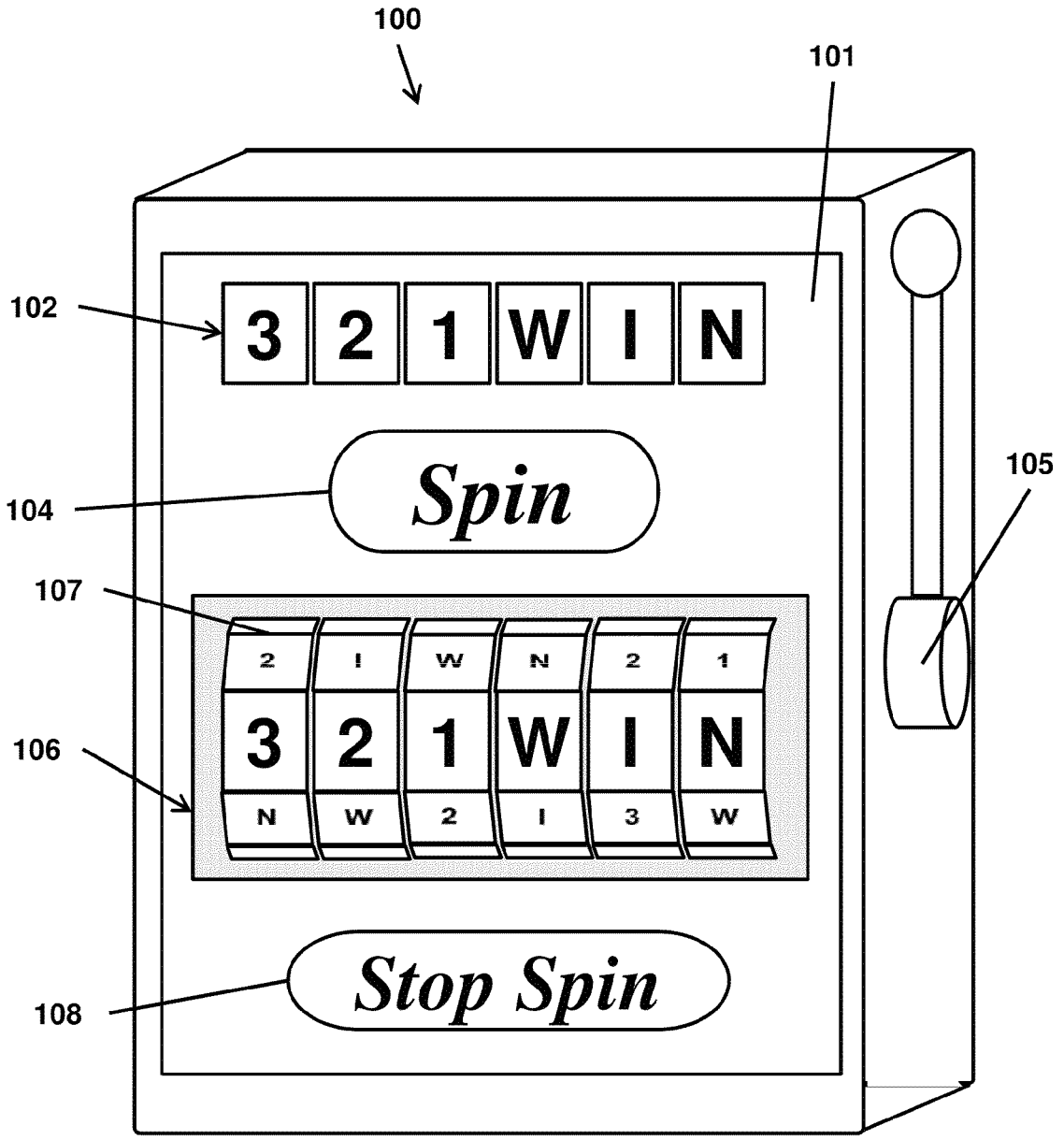
FIG. 1 is an illustration of an embodiment of a slot game device.

Exemplary embodiments of the present invention are directed to new slot machine games, and to systems and methods of administering them. The invented game distinctly departs from the traditional slot-type game in which a group or field of symbols or indicia are represented on the spinning wheels in which various, predetermined combinations result in an award to a player when such a combination is displayed on the spinning wheels when they stop turning. Instead, embodiments of the invention may utilize a target combination of virtually any combination of letters, numbers, symbols (e.g., "@" and "#") or other indicia to represent a player's wager, thereby permitting a much greater level of customization and personalization in a player's selection, or bet, and the gameplay experience. No known slot games provide a slot game wherein the winning combination is selectable by the player of the slot game, as provided herein. As described in further detail below, a player may input, select or otherwise designate a combination of alphanumeric characters when participating in a slot machine game, and in doing so may choose to play combinations that may have some secondary meaning, such as Twitter handles (e.g., "@playername") or trending hash tags (e.g., "#casinonight"), or combinations that have a greater appeal to superstitious players by adding an additional degree of "luck" to the bet by playing the names of grandchildren, street addresses portions, or favorite colors, numbers, alma maters or sports teams, for instance. The addition of the symbols "@" and "#" also bring into play the evolution of social media communication such as Twitter's use of #'s and FaceBook's use @. As used herein, the term "character" shall generally be understood to encompass letters, numbers, symbols and other indicia as described above.

A player's selected combination, or target phrase, may serve, for instance, to either directly or indirectly identify the player who has made the selection. For example, a player may wish to select his or her name and favorite number as a combination. Other players may select nicknames, favorite team names, inside jokes or other similarly meaningful combinations that indirectly associates the chosen combination with the player, but does not necessarily identify the person making the selection to those in the general public. As will be described in further detail below, the slot game may optionally include the use of a means for displaying participant combinations while the game is being played, in order to further increase the excitement of the game.

Because of the public nature of slot games, in some embodiments of the invention, character combinations chosen by a player may be compared to a list or database of character strings that contain potentially profane, sexual, racist or other offensive terms before being allowed to be used in a slot game. If the combination chosen by the player corresponds to, or contains a substring that matches an illicit term or disallowed phrase in the "banned" or exclusion list or database, the player may be notified that the combination is not permissible as a selection. To continue, the player will be asked to enter another combination. It is preferred that player combinations are compared against such a list because, as will be described in further detail below, the chosen player combinations may eventually be displayed publicly on conspicuous displays in certain circumstances, and in particular when a winning combination is announced.

The advantages of the invention further include the ability to create themed games corresponding to, for instance, specific sports teams, sport leagues, and prominent events. The use of connected, multiplayer game instances, as described herein may further increase excitement and engagement of players participating in such games, particularly in nonmonetary situations such as via social gaming networks, or in monetary wagering-type games wherein a common jackpot is provided. Nonmonetary denominations or credits may be tracked for users and used to incentivize monetary contribution during game play, for example by requiring larger amounts of in-game credits to access additional game instances or to access game instances connected to other players through a computerized network. In some embodiments of the invention, players may win such credits through successful participation in game instances, or by purchasing, for predefined fees, in-game credit packages.

Gaming Device

Players may participate in embodiments of the invented slot game generally by way of a gaming device. It is preferred that the invention be implemented in part on one or more computing devices having memory, data storage or generally a combination thereof suitable for the purposes described herein in view of a particular application, input/output means such as a display device or player interface device, and one or more processors. A "gaming device" for the purposes of this disclosure means any such computing device on which a player may participate by engaging in a slot game of the type disclosed herein. Participation in the game may include the ability to choose a specific game instance in which to participate, to choose a bet name or play—i.e., a combination of characters chosen from the group of possible indicia—and may also comprise placing a wager amount thereon (e.g., a monetary or non-monetary sum having a definable value). A player may participate by manipulating a gaming device in order to carry out those tasks. Gaming devices may include, without limitation, mobile phones, personal computers, tablets, laptops, kiosks, mainframe access terminals, servers, game cabinets such as those commonly used in casinos and other locations, point of sale terminals and the like. A gaming device may embody the invented systems and methods disclosed herein by way of executable software code or routines programmed and stored within its data storage means or on computer-readable media, on a second networked device accessed by the gaming device, such as a slot game administration server, by execution of instructions received remotely, or a combination thereof. Some functions of the gaming device, such as accepting payment, may be carried out by way of periphery device or service, such as a card reader, or payment processing service, for instance.

As illustrated in FIG. 1, an exemplary gaming device 100 may comprise a display device 101. The display device may be CRT, LCD, LED, or the like, and may further encompass touch screen devices used for receiving user inputs in addition to rendering images, such as with known smart phone displays and gaming cabinets. The display device may be configured to display a target phrase 102, a "start/spin" control or other similar control 104, and a plurality of wheels 106 that spin to reveal characters. Note that a physical legacy lever or other similar control 105 may be included to activate a spin in some embodiments, either in addition to or in place of the display-rendered "spin" button. The plurality of wheels 106 preferably are embodied as a rendered digital representation, in order to permit the manipulations and customizations as provided in further detail herein. Each wheel 107 in the plurality of wheels 106 is populated with a plurality of outcome characters that make up an outcome set, wherein the plurality of outcome characters define the outcomes possible for each spin of the wheel. The plurality of outcome characters are preferably randomly or pseudo-randomly generated prior to receiving a spin signal via the control 104 or lever 105 based on game parameters, a set of available characters, the target phrase, or a combination thereof.

When a player wishes to start play, a target phrase may be selected. Alternative embodiments may exist in which the phrase may be preselected by an administrator, or by another player in multiplayer embodiments. A player then activates the control 104 or lever 105 to produce a spin signal, whereupon the plurality of wheels each populated with an outcome set start to spin. In some embodiments, the wheels may spin for a period of time and then come to rest, displaying one character per wheel (or payline in embodiments employing the use of multiple, optional paylines). In other embodiments, the wheels may continue to spin until a player performs an action such as activating a "stop" control, such as at 108. The goal of such a slot machine game is to match the target phrase with the characters displayed on the wheels 106 after those wheels come to a stop. In a typical configuration, the wheels will stop on a random character in the outcome set corresponding to the wheel, resulting in a game of chance in which the odds of winning are determined by the number of wheels, the number of characters per wheel, and certain preselected game parameters.

Note that, in embodiments wherein the target phrase is selected by the administrator and transmitted to the gaming device, the invention affords slot game administrators with the opportunity to allow third parties to sponsor target phrases. For example, a third party may wish to promote a brand by paying the slot administrator to use the brand or elements of the brand to construct the target phrase on a given day. The game parameters may be set, as further described herein, such that the first player to spin a matching total spin result is rewarded a jackpot or such other sponsor provided reward. Similarly, one or more players could receive rewards of various sizes for spinning a fully or partially matching total spin result. Those skilled in the art will recognize that such varieties and possibilities are desirable, and create an advantageous revenue stream for administrators, as well as a medium for additional "eyes" for the brand owner.

While embodiments of the invention may be implemented on mechanical slot machines, the preferred method would involve the use of a computer controlled slot machine to allow the features described herein to be implemented and customized more readily. As will be understood, computer controlled slot machines may be configured using software instructions or routines executed using general purpose computer devices, including but not limited to, personal computers, computer servers, portable computing devices, smart phones, and handheld gaming devices. As such, hereinafter references to "slot machine" will be understood to refer to both devices such as traditional gaming cabinets and also computer devices that are configured using software to display slot machine-type games, such as smart phones and tablets. In addition, as used herein, slot game may be used to refer to a device that allows a player to play a slot type game, or the slot type game itself.

Figure 2:
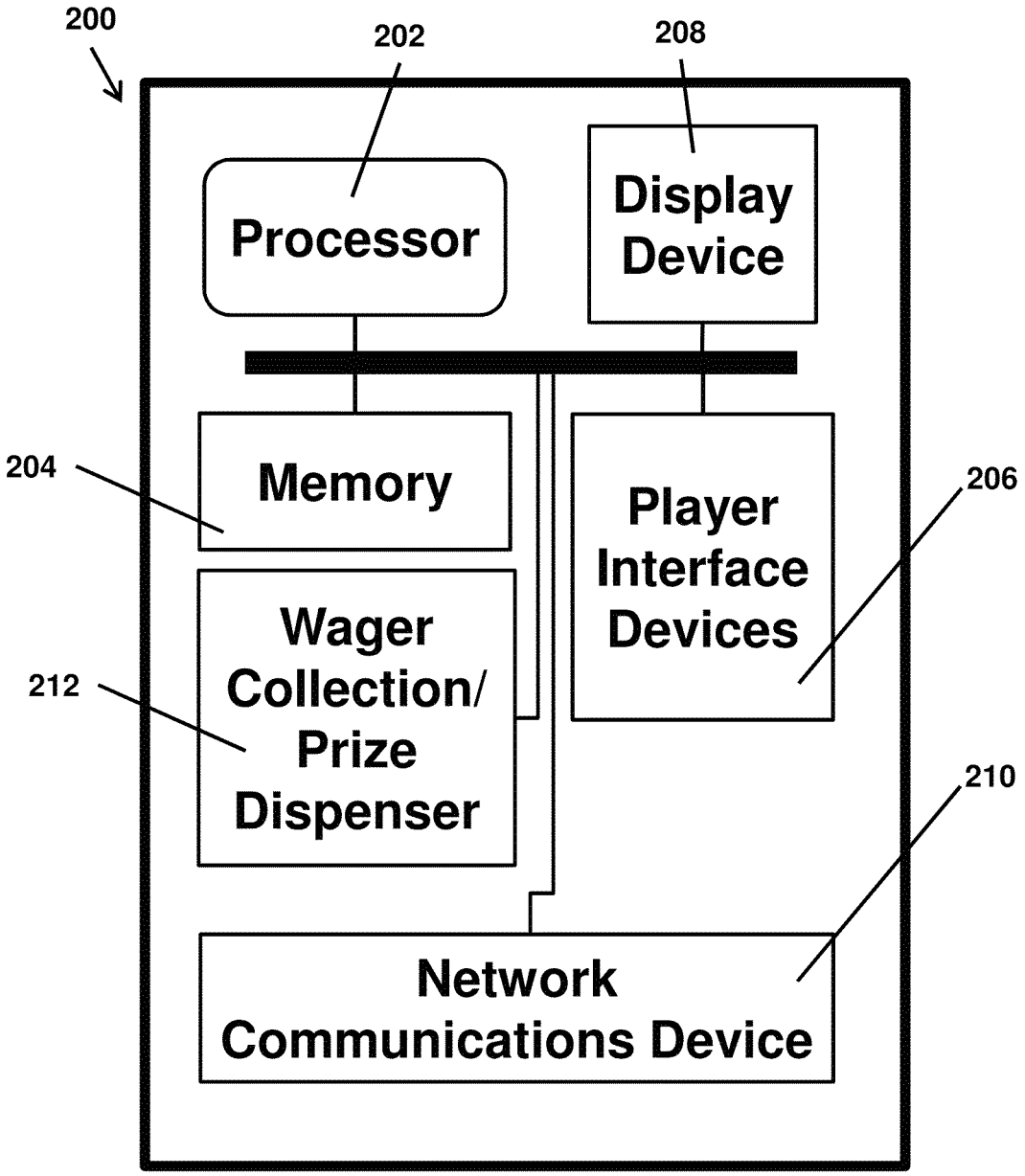
FIG. 2 is a schematic view of an exemplary embodiment of an alphanumeric slot game system.

FIG. 2 illustrates components of a typical computer controlled slot machine 200. As is illustrated, such an embodiment may comprise a processor 202, a memory 204, player interface devices 206 and a display device 208. The player interface devices 206 may comprise, but are not necessarily limited to, push buttons, a touch screen interface (in which the functions of 206 and 208 would be combined), speakers or other sound producing devices, and pull levers are commonly found on slot machines as is illustrated in FIG. 1 at 105. Other components may include network communications devices 210 and devices 212 for collecting payments from players and for distributing prizes and other winnings to players should those players receive such prizes during game play.

Figure 3:
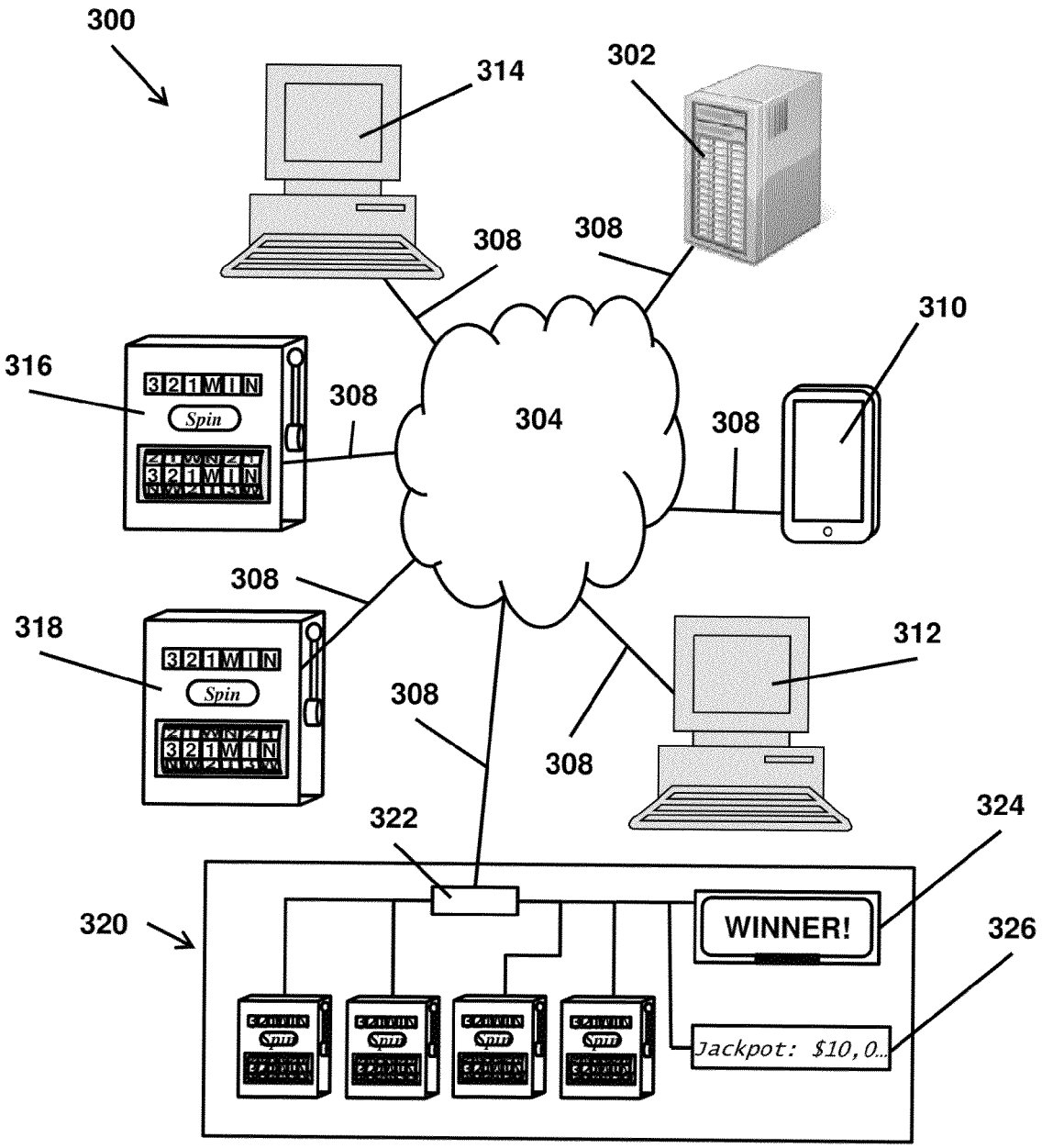
FIG. 3 is an illustration of embodiment of the invention configured using a computer network.

FIG. 3 illustrates an embodiment of a computer controlled slot machine system 300 which comprises a slot administration server 302, a network 304 in communication with the server, and one or more gaming devices (e.g., 310, 312, 314, 316 and 318) in communication with the network 304. In such an embodiment, the gaming devices may be computerized devices that are configured using software to perform slot machine functions comprising such functions as displaying a user interface, receiving input from player interface devices, displaying simulated slot machine "wheels", game status, and sending and receiving game data from the server 302. Alternatively, gaming devices may be configured to receive web pages that are generated by a web server where the game functions are performed by the web server and displayed as web pages by the gaming device, or as a combination of server- and client-side scripting. Such embodiments allow an operator greater flexibility and control over the operation of the slot machine system.

Game System

Referring again to FIG. 2, a schematic view of an exemplary embodiment of a computer controlled alphanumeric slot gaming device 200 in accordance with the invention is depicted. The components of the game may also be optionally operated via a network as illustrated in FIG. 3. Depending upon the particular embodiment, the network 304 may comprise one or more data communication/network means such as private networks, the internet, wide (WAN) and local (LAN) area networks, a virtual private network (VPN), cellular or other wireless networks, digital subscriber (DSL) or other telephone line, Bluetooth connection, etc. A plurality of gaming devices as previously described is depicted wherein each gaming device is in communication with a slot administration server 302. Communications links 308 are shown and generally represent data/communication connections of types corresponding to the particular network 304 composition chosen for a given implementation, and may represent the combination of several physical links or protocols now known or later developed. For example, the communication links 308 may represent one or more wired or wireless connections such as but not limited to a WiFi, Bluetooth, telephone, Ethernet, 3G, LTE, optical fiber, satellite, cable, T1, T3 or other such link appropriate to carry out communication via the network configurations chosen.

The slot game administration server 302 is also operatively connected to the network 304 via a communication link 308. For the purposes of this disclosure, a "slot administration server" is defined as a computing device or group of such devices programmed and configured via software routines executing thereon to administer a slot game as described herein. It can be embodied in a single computing device, such as a desktop or laptop computer, a single server or scalable rack server system, or the like. It may also be embodied as a group of networked servers, for instance, and may include one or more databases, database servers, payment processing gateways, and the like. Although the slot administration server 302 depicted in connection with FIG. 3 is shown as a single computing device, it will be understood that the server 302 may comprise multiple devices operating together, and that to avoid confusion, this disclosure does not describe in detail the structures or equivalents known to those skilled in the art for performing some of the sub-functions described herein. In general, the meaning of the term slot administration server is meant to encompass one or more computing devices generally including input/output means, memory, data storage or generally a combination thereof suitable for the purposes described herein in view of a particular application, one or more processors, and executable software code or routines programmed and stored within its data storage means or on computer-readable media, or on a second networked device accessible to the slot administration server, or a combination thereof.

The slot administration server 302 may be utilized by a slot administrator generally to make the slot game available to others to play. Slot administrators may include, for instance, casinos, gaming enterprises, lottery commissions or the like. Those skilled in the art will appreciate that the slot administration server 302 may include systems necessary to process and account for wagers, or can be communicatively linked to third party vendors that contract to provide those services. The slot administration server 302 may include high security electronic data systems for the handling of sensitive information separately from non-sensitive information. For the purposes of brevity and clarity in the instant description of the invention, such subsystems known to and readily applied by those skilled in the art will not be described in detail in this disclosure.

As illustrated in FIG. 3 an alphanumeric slot gaming system 300 may include a plurality of gaming devices 310, 312, 314, 316 and 318. As mentioned previously, a particular gaming device may be configured as a self-service gaming device similar to keno machines currently found in casinos and other entertainment facilities. Several gaming devices may be grouped together on a subnet, for example all of the gaming devices at a particular casino 320 may be networked together by a communication link(s) 308, with access to the network 304 controlled by a router or other such known networking devices, one or more additional location or subnet-specific slot administration server components, or a combination thereof 322. Those embodiments may also be provided with optional multiplayer slot game display devices, such as at 324 and 326, wherein winning spin results, jackpots and other such game information may be publicly displayed, thereby adding excitement and attracting attention to the invented slot game. Other standalone gaming devices 316, 318 may be located individually at various locations, including convenience stores, bars and restaurants, and other desired locales. For example, gaming device 316 might be a self-service gaming cabinet located at a tavern. Gaming device 314 might be a point of sale slot gaming device operated by a convenience store clerk to place wagers on behalf of customers.

In the aforementioned embodiments, the gaming device 314, 316 and 318 may have executable instructions stored in data storage means or removable computer-readable media for displaying a user interface to assist players or their agents in placing a wager. Alternatively, the gaming device 314, 316 and 318 may act as a terminal, wherein the slot administration server 302 executes the code to perform the steps described herein. Other gaming devices, such as the personal computer 312 and mobile phone 310 embodiments, may similarly use one or a combination of these methods to implement the slot game. For example, the mobile phone gaming device 310 may execute software code from an installed mobile application, interacting with the slot administration server 302 to allow a player to place bets using the phone 310. The personal computer 312 may be used to visit a website in a similar manner, or vise versa.

Embodiments of the invention may be configured to allow players to participate purely for entertainment purposes. In such embodiments, a player may be charged a nominal amount for the right to play the game or be permitted to play without a charge. Other embodiments may be configured to allow a player to place wagers on the outcome of the slot machine game and have provisions for collecting monetary amounts from players prior to playing and paying prize money amounts to winning players after play concludes. Still other embodiments may fill the spectrum between the previously described embodiments, including examples that charge players for playing the game but don't award monetary amounts to winners.

Slot Game Using Selected Target Phrase or Combination

A preferred embodiment of the invention may permit players to chose any combination of letters (A-Z and a-z), numbers (0-9), and the symbols "@", "#" and "&" where the final combination selected by the player has between 3 and 12 characters. It should be understood that less or more of the preferred set of possible alphanumeric characters may be available to players without departing from the scope of this disclosure, and may generally include other indicia as well, such as non-Latin character sets, graphical images, videos or other such media, for instance. Furthermore, the total number of characters permitted may be altered depending upon a specific application and desire of those using the invention, and the range of 3-12 characters is merely provided by way of example. The use of spaces is also optional, and the preferred method of handling spaces is discussed in further detail below.

A game administrator may optionally choose a minimum or maximum number of characters that a player may choose in any given combination, or both. Similarly, in certain embodiments of the invention, symbols other than the "@", "#" and "&" may be used as potential characters. As such it is understood that the set of possible alphanumeric characters from which players may construct a combination may be comprised of any desired group of indicia, including upper and lowercase letters, numbers, punctuation, non-Latin alphabet characters, emoticons, other symbols and images, and the like, and it is not intended that the possible indicia be limited by this disclosure. The characters chosen by a player are also preferably able to be repeated in a single combination to allow for greater flexibility when selecting a combination. For instance, a player might wish to play combinations such as "321 WIN", "LADYLUCK123", "#GoBucks13", "@JohnSmith" or "Scarlet&Gray". As will be noted in the example of LADYLUCK123, the letter "L" is used twice, and in Scarlet&Gray the letter "a" is used twice.

A set of available characters associated with a given version of the game is provided from which a target phrase is constructed. For example, in a preferred embodiment wherein letters (A-Z and a-z), numbers (0-9), and the symbols "@", "#" and "&" are selectable for use in constructing a target phrase, those aforementioned characters make up the set of available characters. The target phrase is made up of a plurality of characters derived from the set of available characters, and those characters chosen each correspond to a position in a plurality of positions having a linear order. For example, the target phrase "LADYLUCK7" has nine positions, each corresponding to the nine characters making up the combination. In some embodiments, the player may construct the target phrase by selecting characters from the set of available characters until the player is satisfied or the character limit is reached. In additional embodiments, the gaming device may be configured to generate a target phrase for a particular game. Multiplayer embodiments of the slot game, in which a plurality of players participate on a plurality of gaming devices in a slot game instance, may optionally be configured such that one player in the plurality of participating players selects the target phrase, which is received via a network communications device of the slot administration server and distributed among the plurality of gaming devices. In this manner, the players participating in a slot game instance compete to match a target phrase selected by one of the players. In other embodiments, the slot administration server is configured to generate the target phrase based on the set of available characters and certain game parameters.

In some embodiments, it is preferred to display the target phrase for a particular game instance on the display device of the gaming device(s). Displaying the target phrase during gameplay will, for example, allow the player to quickly discern matches made on the wheels and visually compare the spin results to the target phrase.

In any event, once the target phrase has been selected for a particular game instance, a wheel is prepared for each position in the plurality of positions of the target phrase. For each wheel, an outcome set is generated that is made up of a plurality of outcome characters. The outcome set for each wheel defines the possible outcomes that may be the result of a single "spin," wherein the wheel is rendered in a spinning state and comes to rest on one of the outcome characters that make up the outcome set. The outcome set for each wheel is preferably randomly or pseudo-randomly generated based on one or more of: the game parameters, the set of available characters, and the plurality of characters in the target phrase. For example, in some embodiments the outcome set for each wheel may be generated based solely on the characters of the target phrase, wherein the target phrase of "JOHN" would result in an outcome set comprised entirely of the characters "J," "O," "H" and "N" (e.g., "ONHHJN"). Alternatively, the set of available characters could be included with weighted target phrase characters (e.g., "JNQOOTH"), or form the basis for the outcome set alone (e.g., "JFSCVOMN"). The game parameters for a game may define rules by which the outcome sets are generated. Those skilled in the art will appreciate that the size and make-up of the outcome set will directly affect the chances of spinning a correct or partial match relative to the target phrase on any one spin. In some embodiments, the size of the outcome set is constant and predetermined, while in others it is variable, for instance chosen by the player or defined in the game parameters associated with the particular slot game instance. The outcome set for each wheel may be generated at the processor of the gaming device according to software routines stored thereon or received via a network communications device, or may alternatively be generated by a slot administration server and transmitted to a gaming device via network communications devices.

Once an outcome set has been generated for each wheel, the wheels may be displayed on the display device wherein each wheel is populated with the outcome set. In some embodiments, spaces may be defined as a selectable character. In others, the space may not be used. In yet other embodiments, space may be allowed only as a visual aid for use in target phrases constructed from several terms, numbers and the like, but do not count as a position in the target phrase. For instance, the target phrase "Go Bucks" would be, in the latter case, made up of 7 positions with a space between the second and third position. In this example, the first two wheels would be displayed, followed by a space, followed by the remaining five wheels for a total of 7 wheels in all. Note also that, the target phrase may optionally be compared to an exclusion list to determine whether the target phrase or any portion thereof corresponds to a disallowed phrase in the list, prior to displaying the target phrase on the display device of the gaming device, or on a multiplayer slot game display device for more conspicuous public display.

Once the plurality of wheels have been associated with outcome sets and displayed on the display device of the gaming device, the player actuates a spin control or lever, wherein a spin signal is received by the gaming device. All wheels are next displayed in a spinning state on the display device in response to the receipt of the spin signal, wherein the spinning state is a graphical rendering of the wheels in a spinning motion. Thereafter, each wheel is displayed in a stopped state on the display device wherein an outcome character from the outcome set corresponding to the wheel is depicted as a spin result. It is preferred that each wheel is stopped in succession as in traditional slot games, rather than concurrently, although the systems and methods may optionally employ either scenario. Once all wheels have been displayed in stopped state, the total spin result is displayed, made up of the spin results for all wheels.

The slot game is then finalized in a settlement stage, wherein pay table information is retrieved from a pay table. The pay table may optionally be stored on the storage device of the gaming device, the storage device of the slot administration server, or in another like location, retrievable via a network communications device of a gaming device, slot administration server, or a combination thereof. The pay table information stored therein may contain the payoff amounts corresponding to the possible outcomes of a total spin result. A reward is determined in some embodiments by comparing the total spin result to the pay table information, dispensing the reward when it exists or is not null, and ending the slot game. The reward may be, for example, a monetary amount based upon the amount wagered and dispensed by the gaming device or deposited into a bank account, a non-monetary amount of credits tracked by the slot administration server, or a variety of other means by which rewards may be allocated for successfully playing the game.

Game Parameters

Game parameters are generally rules, options settings and the like that define a particular instance of a slot game and are associated therewith. Game parameters may be loaded by a gaming device during a slot game, selected or defined by a player or slot administrator during game initialization, or a combination thereof. For example, a game parameter may define the set of available characters from which a target phrase may be constructed. Some embodiments of such a game parameter are provided as a character set, which is a record of the plurality of characters making up the set of available characters associated with the particular game instance. In other embodiments, the set of available characters may be defined by game parameters such as character parameters that reference one or more character sets stored in a storage device on the gaming device of a slot administration server. Game parameters include generally outcome parameters, which encompass parameters that affect the outcome sets, and gameplay parameters, which encompass parameters that affect the gameplay phase of a slot game instance. Examples of the former include, without limitation, character parameters, color parameters, wild character parameters, and Boolean settings for options such as whether replacement is or is not allowed when constructing a target phrase from the set of available characters. Examples of the latter include, without limitation, a spin limit integer, which determines whether and how many extra spins are permitted, a time limit for timed game instances in which multiple spins are permitted, and Boolean settings for options such as whether the reordering of spin results is or is not allowed. The aforementioned parameter labels are provided for convenience and are not considered limiting. Some game parameters may be appropriately classified under both or neither of the aforementioned categories. For instance, an order Boolean setting may be desired wherein a true setting means that the order of the spin results matter—i.e., the total spin result of "BCUKS" does not match the target phrase "BUCKS"—and a false setting means that the order of the spin results does not matter, and the latter example would be a winning total spin result.

Skill Based Variations

Embodiments of the invention may add a skill component by allowing a player to actuate a control on an instance of the slot game that causes one or more wheels to stop. As illustrated in FIG. 1, a control may be a digital or physical push-button 108. In other embodiments where a touch sensitive display device is used, a player may push a simulated push button or simply tap the spinning wheel 107. In such an embodiment, a player's ability to anticipate the appearance of the desired character and cause such a selection at the correct time may increase that player's chances of winning. Similar embodiments may vary the difficulty of selecting the correct symbol by rotating the spinning wheels more or less rapidly to increase or decrease the difficulty of selection. An administrator may wish to increase or decrease the amount that a player may win when playing the slot game to account for the increase or decrease in difficulty that results from wheel speed. In some embodiments of the invention, wheel speed may increase as a player selects each wheel, making the selection at the first wheel easier than the last in order to entice the player to continue playing. In other embodiments, the push-button 108 may be configured to simply display (i.e., stop a wheel from spinning) results that are predetermined at the initial spin moment, without actually affecting the outcome of the game.

Multiple Colors

In some embodiments of the invention, a slot game may be established by the slot administrator in which more than one character color is utilized. For example if the player selected a phrase "BILL4" using a slot game device that has five wheels, in a non-color version of the slot game device, each wheel may have four characters, a "B", an "I", an "L", and a "4," and may be arranged in random order, with or without duplicates. In an embodiment that also uses colored characters, each wheel may have, in this example, a red "B", a blue "B", and a green "B", a red "I", a blue "I", and so-forth for each of the five wheels. In such an embodiment, if the selected phrase color is green, then the player may earn the highest score when the wheels stop turning to reveal "BILL4" in green characters, a lesser score for a "BILL4" with four green characters and so-on until "BILL4" does not appear in any color combination on the wheels. Such a slot game embodiment may be particularly attractive in a networked, multi-player slot game embodiment as will be described later herein.

Wild Cards

In addition to characters and colors as described above, embodiments of a slot game may incorporate "wild-card" characters. In an embodiment of the invention that incorporates wild cards, a player or administrator may select, prior to the start of a slot game, a character that when it appears, may represent any other character. For example, if the selected target phrase is "BILL4" as was used above and a wild-card character is selected to be "0" then a result when the wheels stop turning of BILL4 would be a winning result but, because of the wild character, a result of BIQL4 would also be a winning result. A rainbow or other such indicator color may optionally be used to represent a wild card for color only. For example, a wheel stopping on a rainbow colored "B" could be used to match the selected winning color. As with other embodiments of the slot game, points or other awards received by players may be computed using the mathematical odds of winning as impacted by the addition of wild-card characters.

Other Variations

Embodiments of the invention may also allow players to select multiple target phrases for a wheel spin. Such embodiments may increase the chances that a player wins, building player excitement and encouraging continued play. An alternate embodiment may be a single target phrase with multiple sets of slot wheels. As with multiple target phrase embodiments, multiple wheel configurations may increase a player's changes of winning, also building player excitement. Multiple paylines may also be included for similar affects.

In another embodiment of the invention, when a wheel stops on a correct character in one position, that character may be removed from the rest of the spinning wheels, increasing the chances of a player winning. For example, in a game with the target phrase of "BILL4", each wheel in such an instance of the slot game may contain the characters "B", "I", "L", "L" and "4." If the first wheel stops at "B", then in such an embodiment of the game, the "B" character may be removed from the remaining wheels, increasing the chances that each successive wheel will stop on the correct character. In the example, if the first four wheels stop on "B", "I", "L", and "L", the last wheel may contain only "4" and as a result, the player may win after the forth correct character. Similar embodiments may have additional characters such that the play may not be guaranteed the correct character in the fifth wheel as just described.

As with the other variations described, winning scores or awards may be determined mathematically according to the odds faced by a player in the various embodiments employing wild cards, color, and decreasing characters as the game progresses, as defined in the game parameters for a given game instance.

In embodiments in which multiple spins are desired, a spin limit integer may be used as a game parameter. When the spin limit integer is nonzero and positive, additional spins are activated and available to the player. In some embodiments, after an initial spin is concluded, 1 is subtracted from the spin limit integer and a further, additional spin is conducted. The additional spin process is repeated until the spin limit integer reaches zero, at which time the final total spin result is taken as the result for that game. In some embodiments, the total spin result generated after each spin is recorded in a total spin result array, wherein the multiple spin outcomes are used to arrive at the reward, if any, to be dispensed. For example, the best result of each wheel, the best total spin result in the array, or the like could be used in conjunction with the pay table information to arrive at the final reward for the game.

In embodiments of the invention, players may be encouraged to continue playing by a slot machine that allows the player to hold some characters while causing the remaining wheels to spin an additional time. For example, if the target phrase is ASPEN1, a first play of the game may result in the wheels stopped displaying ANEPS1. In an embodiment that allows a second spin, the player may "hold" the first and last wheel while attempting to get the center four wheels into the correct "SPEN" order. As with other embodiments of the invention, the awarded score or award may be based on the odds remaining after the first spin. Alternatively, the winning award or points may remain the same for the second game but the player may be required to spend a higher number of points or money to spin a second time. The player may hold characters between from one spin to another by actuating the player interface to set a hold Boolean to true for one or more wheels in the plurality of wheels. On the next spin, all wheels for which the corresponding hold Boolean remains false will be displayed in a spinning state on the display device and new spin results will be displayed when they come to rest in the stopped state.

In some embodiments, the player may be permitted to reorder the wheels between spins in a multiple spin instance of the slot game. Such a feature may be provided by including a reorder Boolean set to true as a gameplay parameter, and displaying a reorder control on the display device of the gaming device whereby a player may make a reorder input defining a new order for two or more wheels in the plurality of wheels. This feature may be combined with the "hold" option to allow for reorder and holding features in combination during multiple spins in a game instance. This can occur, for example, either in game instances having a spin limit or a time limit—i.e., the player may re-spin up to a certain predetermined number of times, or during a certain predetermined amount of time. Time limits may be provided by including a time limit gameplay parameter wherein the time limit is a positive amount of time. In some embodiments, a timer control is actuated during gameplay to track an elapsed time. After each spin, the time remaining is calculated as the difference between the time limit and the elapsed time. When the difference goes to zero, no more spins are permitted.

In other embodiments, an administrator may reduce the difficulty of matching the target phrase by requiring only partial matches or allowing a match when a player has the correct characters but not the correct order. Similarly in embodiments that allow a player to have additional chances (spins), a player may be awarded additional chances to obtain a correct match.

Other embodiments may permit a player to spend an additional amount of money or points prior to playing an instance of a slot game to pre-purchase correct characters, a reduced number of characters per wheel or "buy" wild cards. For instance, a player may wish to increase the odds of winning by decreasing the number of characters on each wheel. In such an example embodiment, a player may be required to spend a greater amount in order to play a slot game with decreased character numbers on one or more wheels. Again, an administrator may configure embodiments of the invention to award a winning player according to the odds of the correct target phrase appearing on the game wheels based upon game parameters.

Some embodiments of the invention may allow a player to shift a character from one space to another in the midst of a game. For example, a player may select the target phrase "SUE80" at the start of a game. As the game is played, the first wheel at the first position may stop at "8." In the example embodiment, the player may be presented with the option to move the "8" character from the first position to the forth position. A player may be asked to spend an additional amount to enable the character to be moved. After the move, the player may continue to game, in hopes that the first position will stop at "5", the second at "U" and so-on.

Embodiments of the invention may be configured to permit a player to change the color of displayed character in an instance of the game that has multi-colored characters enabled. A first wheel may stop on the correct character but have the wrong color. In such an embodiment the player may be presented with the option to change the displayed color to the correct color to increase the likelihood that the correct characters and colors will be displayed after all wheels have stopped. As with other embodiment variations, a player may be required to spend an additional amount to make such a change, the amount of points or other awards may be reduced or a combination of the two may be applied. In such a manner, the player's chances of winning may be increased but that change may be offset to keep the awards for winning commensurate with the changes that may have taken place to the odds of winning.

In each of the above embodiments where a player is provided the ability to modify the game output, purchase wild cards, take additional spins, etc., for an additional cost, such an option may be presented after the game has started, or alternatively, before the start of the game. In social versions of the game, some of the options to modify game output, change the color, etc. may be prize awards given for continued play.

It should be understood that variations of the invention, including but not limited to varying the number of characters used, implementation of additional character types, the possibility of repeating characters, wild card characters, and other means of reducing the odds of the selected combination may be made available without departing from the scope of the invention. It will also be understood that such variations may be used to either increase or decrease the odds of a player winning the slot game and thus may alter the payout odds. As was described herein, an administrator may be provided with the ability to adjust the points or other amounts paid upon winning to compensate for the varying odds of a player's winning.

Figure 4:
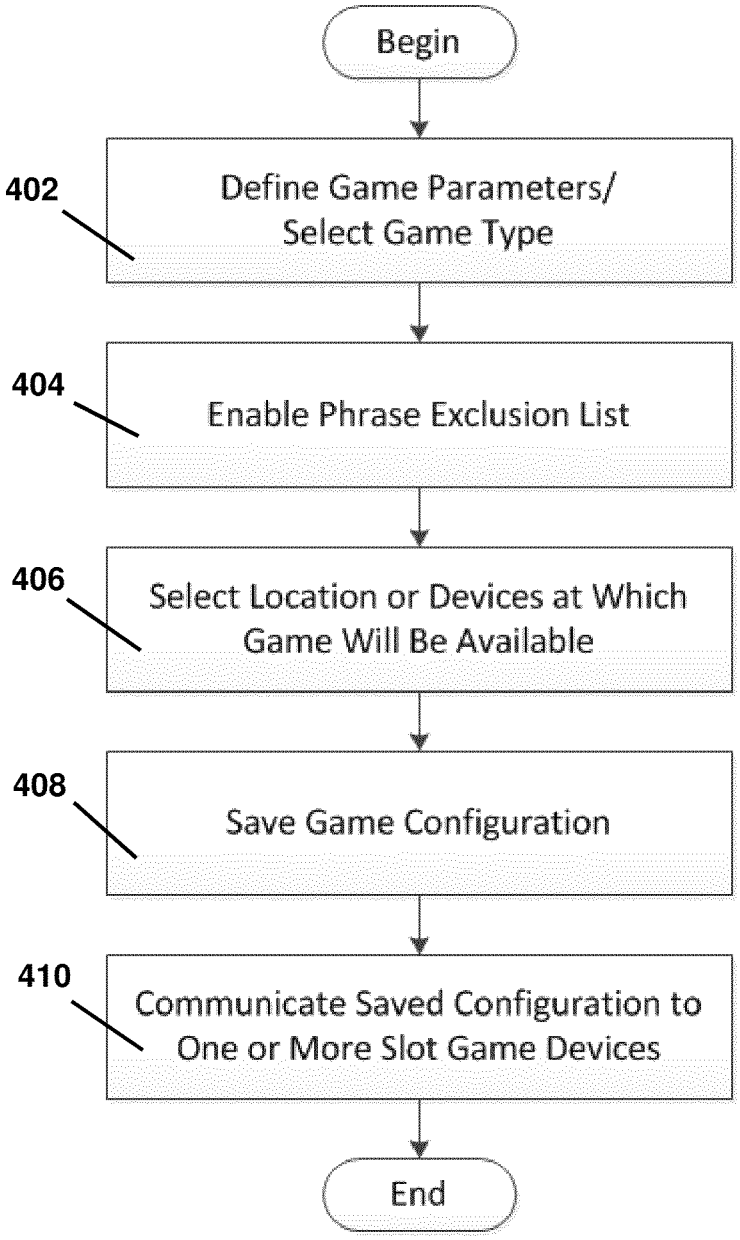
FIG. 4 is a flow diagram of an exemplary method related to the administration of an alphanumeric slot game.

Some of the features of the invented slot game are described in connection with FIG. 4, which is a flowchart showing an exemplary embodiment of a method related to configuring the slot game. At 402, a slot administrator creates an instance of the slot game by defining the game parameters or selecting the game type to be played from a set of preconfigured game parameter combinations. In some embodiments the players themselves may choose the number of alphanumeric characters used to play the slot game, or may generally be provided with the option to define one or more game parameters at the outset of the game.

In step 404 the slot game administrator may choose to enter or enable a bet exclusion list, or link to a bet exclusion list library, as described above (both linked and game-specific libraries, tables, databases or lists are referred to as simply an "exclusion list" or "list" hereinafter). The list may be comprised of, for instance, unacceptable terms that are racial, sexual, religious, demeaning, derogatory, etc. that may be continuously updated. In instances in which player phrases are displayed on a conspicuous screen in a manner similar to the display of the numbers on a keno board, or the winning player's phrase being flashed on a public display, the avoidance of offensive combinations is considered preferable.

As is illustrated at 406, a slot administrator may desire to limit the availability of a particular game instance to certain locations or gaming devices. By entering location parameters, games may be created, for instance that are only available to players in a particular casino or casino chain, or those using a particular gaming device or one of a plurality of gaming devices, or otherwise defined by method of access. The game alternatively may be made available only through certain branded convenience stores or via the web only. This option allows generally for the geographic or demographic tailoring of specific types of games, simultaneously increasing player excitement and participation, as well as the potential for slot game revenues to the slot administrator. For hard-coded gaming devices that are not network controlled, this step may be optionally omitted.

At 408, the slot administrator chooses to save and finish the game creation process. The game instance will then be communicated to gaming devices 410 according to the game parameters provided via this process.

Figure 5:
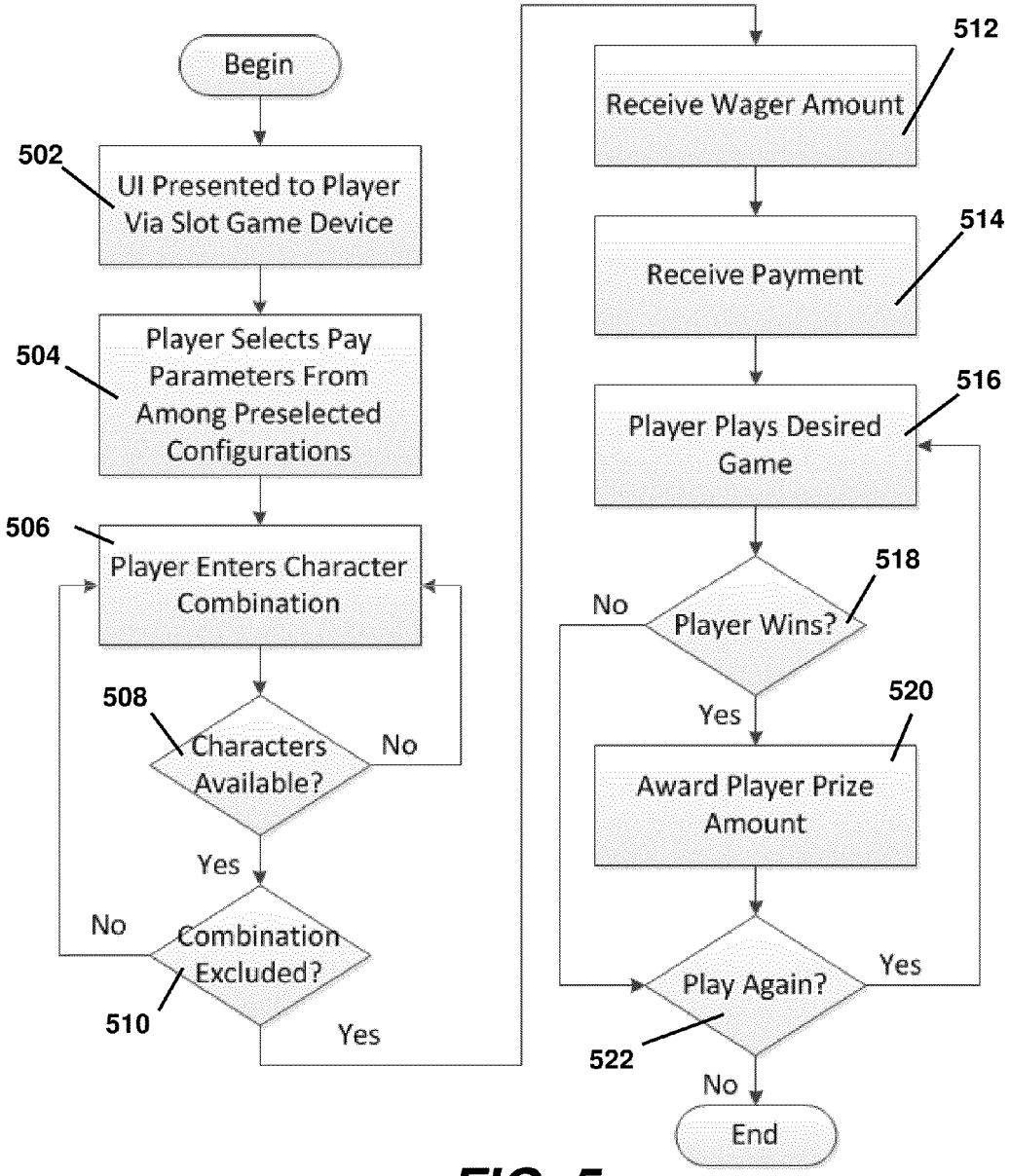
FIG. 5 is a flow diagram of an exemplary method of alphanumeric slot game play and wagering.

Players may interact with a gaming device to place a wager as shown in an exemplary embodiment of a system and method for wagering depicted in connection with the flow diagram in FIG. 5. The process optionally begins at 502, where the player is queried by a user interface (UI—graphical or otherwise) displayed on the gaming device as to the game in which they wish to participate, if more than one game type is made available through the device. This selection process can be configured as a multiple-screen selection process to narrow the selections from many to few, via a single screen, or any other such desirable method. Pay parameters are selected at 504 for wagering instances of the game, such as method of payment desired. This step may occur automatically, for example where a casino "play" card or winnings ticket was presented at the outset, as is known in the art. In other embodiments, for instance mobile device implementations, a payment method or account may already be associated with the device or player.

At 506, the player may enter the play combination of alphanumeric characters chosen from the set of available alphanumeric characters that the player wishes to wager upon. Embodiments of the system may also be optionally configured to randomly generate a play for a player, if so desired. Next, upon a determination that the selected characters are available at 508, and that the character combination is not disallowed at 510, if the slot game involves a wager, the amount that the player wishes to wager on the play is selected by the player at 512, payment is received at 514, and the slot game begins at 516.

The system may determine that the player is a winner 518 if the selected phrase is matched exactly or to a level that represents a winning match depending upon the game played. In step 520 the player may be awarded the prize amount. Such an award may be in the form of points credit, a credit redeemable for cash, or cash dispensed by a cash dispenser in communication with or incorporated into the gaming device. If the player wishes to play again 522, that player may repeatedly play any number of games utilizing the same alphanumeric character sequence if desired, or be optionally returned to any earlier step. Note that the order of steps described herein is not considered limiting unless expressly stated or implied by necessity.

Networked Multi-Player Games

Referring to FIG. 3 which illustrates a game system comprised of a slot administrative server 302, a network 304, and a plurality of slot game devices. In addition to providing a means for an administrator to monitor the activity of slot game devices and players on devices connected to a networked embodiment of the invention, the network 304 may allow an administrator to configure one or more of the connected slot game devices to play versions of slot games that are multi-player in nature. As described previously herein, a slot game may be configured to receive a target phrase, which a player attempts to match using characters appearing on spinning wheels that come to rest on one of the plurality of characters making up a set of possible outcomes on each wheel. As previously described, the target phrase may be selected by a user of the slot game. In certain embodiments, the target phrase may be selected by an entity other than the player such as an administrator. In an exemplary embodiment of a multi-player slot game, a slot administrative server 302 may provide a target phrase to one or more slot game devices connected to a network. In such an embodiment, players playing the multi-player slot game may compete to see which player is the first to exactly match the target phrase. The first player to match or the player with the closest total spin result may then win a larger portion of the points or other award available to the winner of the game than may be available to the remaining players. In embodiments of a first-to-match slot game, players may be awarded points or awards according to how close they have come to an exact match during a predetermined time period or number of spins, for example. These embodiments may provide a player that spins the exact match with the greatest winnings. In some embodiments, those who have come within a predetermined range of an exact match may receive a smaller percentage.

In another embodiment, an administrator may select one or more phrases and communicate phrases at specific start times to those slot games in communication with a slot administrative server. In such embodiments, players using the slot games may compete in one or more games corresponding to the phrases communicated at the various start times. In an exemplary embodiment, the first player to achieve a match to the selected phrase may receive the highest award while those other players that achieved a partial match or a complete match at a time later than the first complete match may receive an award of a lesser value.

In addition to slot game devices and administrative servers, a slot game system may also comprise one or more multi-player slot game display devices. Such devices may be used to communicate game activity to players, potential players or observers. Examples of what may be displayed may include, but is not limited to, winning phrases, the number of characters successfully matched when in a multi-player configuration, information regarding the "pot" or prize available to winners of a slot game, and upcoming games and phrases. In certain embodiments, such information may also be displayed on one or more displays integrated into slot game devices, as at 208 in FIG. 2, or may be provided through a separate, external display device such as a marquee, flat panel monitor or the like. Such embodiments may be particularly useful to generate player excitement and interest among non-players that are within sight of such displays.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A method of providing a slot game on a gaming device having a display device, a player interface device, a memory, and a storage device, the method comprising the steps of:

setting up the slot game in an initialization stage comprising the substeps of:

receiving a set of game parameters associated with the slot game;

receiving a target phrase comprising:

a plurality of characters derived from a set of available characters; and a plurality of positions having a linear order, wherein each character corresponds to a position;

displaying the target phrase on the display device;

preparing a wheel for each position in the plurality of positions, comprising the substeps of:

generating an outcome set comprising a plurality of outcome characters comprising the plurality of characters in the target phrase in a random order; and displaying the wheel on the display device wherein the wheel is populated with the outcome set;

determining a total spin result in a gameplay stage, comprising the substeps of:

receiving a spin signal via the player interface device;

displaying all wheels in a spinning state on the display device in response to receipt of the spin signal; and displaying each wheel in a stopped state on the display device wherein an outcome character from the outcome set corresponding to the wheel is depicted as a spin result, until all wheels are in a stopped state and the total spin result is displayed comprising the spin results for all wheels; and finalizing the slot game in a settlement stage, comprising the substeps of:

retrieving pay table information;

determining a reward by comparing the total spin result to the pay table information;

ending the slot game when the reward is null; and dispensing the reward and ending the slot game when the reward is not null.

2. The method of claim 1, wherein:

the target phrase is received via the player interface device.

3. The method of claim 2, further comprising the steps of:

after receiving the target phrase, parsing the target phrase for a match with a disallowed phrase in an exclusion list comprising a plurality of disallowed phrases;

displaying the target phrase on the display device when no match exists; and displaying a request for a new target phrase on the display device when a match exists.

4. The method of claim 2, wherein:

the set of game parameters comprises a set of outcome parameters comprising one or more of a character set, a color set, and a wild character set; and the outcome set further comprises characters defined by the set of outcome parameters or at least one character from the set of available characters that is not in the plurality of characters in the target phrase.

5. The method of claim 4, wherein:

the set of outcome parameters further comprises a replacement Boolean.

6. The method of claim 2, wherein:

the set of game parameters comprises a set of gameplay parameters comprising a spin limit integer, wherein the spin limit integer is greater than zero.

7. The method of claim 6, wherein the step of determining a total spin result in a gameplay stage comprises the substeps of:

receiving a spin signal via the player interface device;

displaying all wheels in a spinning state on the display device in response to the receipt of the spin signal;

displaying each wheel in a stopped state on the display device wherein an outcome character from the outcome set corresponding to the wheel is depicted as a spin result; and initiating an additional spin, comprising the substeps of:

subtracting 1 from the spin limit integer;

receiving a spin signal via the player interface device and a hold Boolean set to false for one or more wheels;

displaying all wheels for which the corresponding hold Boolean is false in a spinning state on the display device;

displaying each spinning wheel in a stopped state on the display device wherein an outcome character from the outcome set corresponding to the wheel is depicted as a spin result;

determining whether the spin limit integer is greater than zero;

storing in the memory of the gaming device the total spin result when the spin limit integer is not greater than zero, the total spin result comprising the spin results for all wheels; and repeating the substeps for initiating an additional spin when the spin limit integer is greater than zero.

8. The method of claim 6, wherein:

the set of gameplay parameters further comprising a reorder Boolean, wherein the reorder Boolean is true.

9. The method of claim 8, wherein the step of determining a total spin result in a gameplay stage comprises the substeps of:

receiving a spin signal via the player interface device;

displaying all wheels in a spinning state on the display device in response to the receipt of the spin signal;

displaying each wheel in a stopped state on the display device wherein an outcome character from the outcome set corresponding to the wheel is depicted as a spin result; and initiating an additional spin, comprising the substeps of:
subtracting 1 from the spin limit integer;
receiving a reorder input via the player interface device;
changing the position to which a wheel corresponds for at least two wheels;
receiving a spin signal via the player interface device and a hold Boolean set to false for one or more wheels;
displaying all wheels for which the corresponding hold Boolean is false in a spinning state on the display device;
displaying each spinning wheel in a stopped state on the display device wherein an outcome character from the outcome set corresponding to the wheel is depicted as a spin result;
determining whether the spin limit integer is greater than zero;
storing in the memory of the gaming device the total spin result when the spin limit integer is not greater than zero, the total spin result comprising the spin results for all wheels; and
repeating the substeps for initiating an additional spin when the spin limit integer is greater than zero.

10. The method of claim 2, wherein the step of determining a total spin result in a gameplay stage comprises the substeps of:
receiving a spin signal via a lever of the gaming device;
displaying all wheels in a spinning state on the display device in response to receipt of the spin signal; and
displaying each wheel in a stopped state on the display device wherein an outcome character from the outcome set corresponding to the wheel is depicted as a spin result, until all wheels are in a stopped state and the total spin result is displayed comprising the spin results for all wheels.

11. The method of claim 4, wherein:
the set of game parameters comprises a set of gameplay parameters comprising a spin limit integer, wherein the spin limit integer is greater than zero.

12. The method of claim 11, wherein the step of determining a total spin result in a gameplay stage comprises the substeps of:
receiving a spin signal via the player interface device;
displaying all wheels in a spinning state on the display device in response to the receipt of the spin signal;
displaying each wheel in a stopped state on the display device wherein an outcome character from the outcome set corresponding to the wheel is depicted as a spin result; and
initiating an additional spin, comprising the substeps of:
subtracting 1 from the spin limit integer;
receiving a spin signal via the player interface device and a hold Boolean set to false for one or more wheels;
displaying all wheels for which the corresponding hold Boolean is false in a spinning state on the display device;
displaying each spinning wheel in a stopped state on the display device wherein an outcome character from the outcome set corresponding to the wheel is depicted as a spin result;
determining whether the spin limit integer is greater than zero;
storing in the memory of the gaming device the total spin result when the spin limit integer is not greater than zero, the total spin result comprising the spin results for all wheels; and
repeating the substeps for initiating an additional spin when the spin limit integer is greater than zero.

13. The method of claim 11, wherein:
the set of gameplay parameters further comprising a reorder Boolean, wherein the reorder Boolean is true.

14. The method of claim 13, wherein the step of determining a total spin result in a gameplay stage comprises the substeps of:
receiving a spin signal via the player interface device;
displaying all wheels in a spinning state on the display device in response to the receipt of the spin signal;
displaying each wheel in a stopped state on the display device wherein an outcome character from the outcome set corresponding to the wheel is depicted as a spin result; and
initiating an additional spin, comprising the substeps of:
subtracting 1 from the spin limit integer;
receiving a reorder input via the player interface device;
changing the position to which a wheel corresponds for at least two wheels;
receiving a spin signal via the player interface device and a hold Boolean set to false for one or more wheels;
displaying all wheels for which the corresponding hold Boolean is false in a spinning state on the display device;
displaying each spinning wheel in a stopped state on the display device wherein an outcome character from the outcome set corresponding to the wheel is depicted as a spin result;
determining whether the spin limit integer is greater than zero;
storing in the memory of the gaming device the total spin result when the spin limit integer is not greater than zero, the total spin result comprising the spin results for all wheels; and
repeating the substeps for initiating an additional spin when the spin limit integer is greater than zero.

15. The method of claim 1, wherein:
the target phrase is received via a network communications device of the gaming device.

16. The method of claim 15, wherein:
the set of game parameters comprises a set of gameplay parameters comprising a spin limit integer, wherein the spin limit integer is greater than zero.

17. The method of claim 16, wherein the step of determining a total spin result in a gameplay stage comprises the substeps of:
receiving a spin signal via the player interface device;
displaying all wheels in a spinning state on the display device in response to the receipt of the spin signal;
displaying each wheel in a stopped state on the display device wherein an outcome character from the outcome set corresponding to the wheel is depicted as a spin result; and
initiating an additional spin, comprising the substeps of:
subtracting 1 from the spin limit integer;
receiving a spin signal via the player interface device and a hold Boolean set to false for one or more wheels;
displaying all wheels for which the corresponding hold Boolean is false in a spinning state on the display device;
displaying each spinning wheel in a stopped state on the display device wherein an outcome character from the outcome set corresponding to the wheel is depicted as a spin result;
determining whether the spin limit integer is greater than zero;

storing in the memory of the gaming device the total spin result when the spin limit integer is not greater than zero, the total spin result comprising the spin results for all wheels; and repeating the substeps for initiating an additional spin when the spin limit integer is greater than zero.

18. The method of claim 16, wherein the step of determining a total spin result in a gameplay stage comprises the substeps of:

receiving a spin signal via the player interface device;

displaying all wheels in a spinning state on the display device in response to the receipt of the spin signal;

displaying each wheel in a stopped state on the display device wherein an outcome character from the outcome set corresponding to the wheel is depicted as a spin result;

storing the spin results for all wheels on a first row in a total spin result array; and initiating an additional spin, comprising the substeps of:

subtracting 1 from the spin limit integer;

receiving a spin signal via the player interface device and a hold Boolean set to false for one or more wheels;

displaying all wheels for which the corresponding hold Boolean is false in a spinning state on the display device;

displaying each spinning wheel in a stopped state on the display device wherein an outcome character from the outcome set corresponding to the wheel is depicted as a spin result;

storing the spin results for all wheels on a new row in the total spin result array;

determining whether the spin limit integer is greater than zero;

storing in the memory of the gaming device the total spin result array when the spin limit integer is not greater than zero; and repeating the substeps for initiating an additional spin when the spin limit integer is greater than zero.

19. The method of claim 15, wherein:

the set of game parameters comprises a set of gameplay parameters comprising a time limit, wherein the time limit is a positive amount of time.

20. The method of claim 19, wherein the step of determining a total spin result in a gameplay stage comprises the substeps of:

actuating a timer control to track an elapsed time;

receiving a spin signal via the player interface device;

displaying all wheels in a spinning state on the display device in response to the receipt of the spin signal;

displaying each wheel in a stopped state on the display device wherein an outcome character from the outcome set corresponding to the wheel is depicted as a spin result; and initiating an additional spin, comprising the substeps of:

receiving a spin signal via the player interface device and a hold Boolean set to false for one or more wheels;

displaying all wheels for which the corresponding hold Boolean is false in a spinning state on the display device;

displaying each spinning wheel in a stopped state on the display device wherein an outcome character from the outcome set corresponding to the wheel is depicted as a spin result;

calculating a time remaining comprising the difference between the time limit and the elapsed time;

storing in the memory of the gaming device the total spin result when the time remaining is equal to or less than zero, the total spin result comprising the spin results for all wheels; and repeating the substeps for initiating an additional spin when the time remaining is greater than zero.

21. The method of claim 19, wherein the step of determining a total spin result in a gameplay stage comprises the substeps of:

actuating a timer control to track an elapsed time;

receiving a spin signal via the player interface device;

displaying all wheels in a spinning state on the display device in response to the receipt of the spin signal;

displaying each wheel in a stopped state on the display device wherein an outcome character from the outcome set corresponding to the wheel is depicted as a spin result;

storing the spin results for all wheels on a first row in a total spin result array; and initiating an additional spin, comprising the substeps of:

receiving a spin signal via the player interface device and a hold Boolean set to false for one or more wheels;

displaying all wheels for which the corresponding hold Boolean is false in a spinning state on the display device;

displaying each spinning wheel in a stopped state on the display device wherein an outcome character from the outcome set corresponding to the wheel is depicted as a spin result;

storing the spin results for all wheels on a new row in the total spin result array;

calculating a time remaining comprising the difference between the time limit and the elapsed time;

storing in the memory of the gaming device the total spin result array when the time remaining is equal to or less than zero; and repeating the substeps for initiating an additional spin when the time remaining is greater than zero.

22. The method of claim 1, wherein the pay table information is retrieved in one or more of the following manners:

from the storage device of the gaming device;

from an external data source via a network communications device of the gaming device; and from the processor of the gaming device wherein the processor calculates the pay table information based upon the game parameters and the target phrase.

23. A device for playing a slot game comprising:

a storage device comprising:

a set of game parameters associated with the slot game;

a set of available characters associated with the slot game;

one or more software routines; and a pay table comprising pay table information;

a memory;

a display device;

a player interface device;

a processor in communication with the storage device, the memory, the display device and the player interface control, wherein the processor executes the one or more software routines configured to:

display a target phrase on the display device, the target phrase comprising:

a plurality of characters derived from the set of available characters; and a plurality of positions having a linear order, wherein each character corresponds to a position;

prepare a wheel for each position in the plurality of positions by generating an outcome set comprising a plurality of outcome characters comprising the plurality of characters in the target phrase in a random order;

display each wheel on the display device wherein the wheel is populated with the outcome set;

display all wheels in a spinning state in response to a spin signal received from the player interface device;

display each wheel in a stopped state wherein an outcome character from the outcome set corresponding to the wheel is depicted as a spin result, wherein a total spin result is displayed comprising the spin results for all wheels;

determine a reward by comparing the total spin result, the target phrase, the pay table information, and the game parameters;

dispense the reward when the reward is not null; and end the slot game.

24. The device of claim 23, wherein the one or more software routines are further configured to:

generate the target phrase based on the set of available characters.

25. The device of claim 23, wherein the one or more software routines are further configured to:

display a target phrase selection screen on the display device; and receive the target phrase via the player interface device.

26. The device of claim 25, wherein:

the storage device further comprises an exclusion list comprising a plurality of disallowed phrases; and the one or more software routines are further configured to:

parse the target phrase for a match with a disallowed phrase in the exclusion list;

display the target phrase on the display device when no match exists; and display a request for a new target phrase on the display device in connection with the target phrase selection screen when a match exists.

27. The device of claim 23, wherein:

the set of game parameters comprises one or more of an order Boolean, a set of color parameters, a set of wildcard parameters, a replacement Boolean, a spin limit integer, a time limit, and a reorder Boolean.

28. A method of administering a slot game played on a plurality of gaming devices, the method comprising the steps of:

initializing a slot game instance on a slot administration server comprising the substeps of:

retrieving a set of game parameters via a network communications device of the slot administration server, wherein the set of game parameters are associated with the slot game instance;

creating a jackpot record in a memory of the slot administration server; and creating an outcomes record in the memory of the slot administration server;

receiving a participation signal from each of the gaming devices via the network communications device of the slot administration server;

receiving a set of wager parameters from each of the gaming devices via the network communications device of the slot administration server;

storing the set of wager parameters received from each of the gaming devices in the jackpot record;

transmitting a target phrase to the plurality of gaming devices via the network communications device of the slot administration server, the target phrase comprising:

a plurality of characters derived from a set of available characters; and a plurality of positions having a linear order, wherein each character corresponds to a position;

generating a plurality of outcome characters at a processor of the slot administration server comprising the plurality of characters in the target phrase in a random order for each of the plurality of positions;

transmitting the plurality of outcome characters to the plurality of gaming devices via the network communications device of the slot administration server;

gathering a set of outcomes from the plurality of gaming devices comprising the substeps of:

receiving a total spin result from each gaming device in the plurality of gaming devices via the network communications device of the slot administration server; and storing the total spin result for each gaming device in the plurality of gaming devices in the outcomes record; and finalizing the slot game in a settlement stage, comprising the substeps of:

retrieving pay table information;

determining at least one reward at the processor of the slot administration server based on the outcomes record and pay table information; and dispensing the at least one reward.

29. The method of claim 28, wherein:

the target phrase is received via the network communications device of the slot administration server from a gaming device in the plurality of gaming devices.

30. The method of claim 28, wherein:

the target phrase is generated at a processor of the slot administration server based on the set of available characters and the game parameters.

* * * * *